US009474121B2

(12) United States Patent
Shaffer

(10) Patent No.: US 9,474,121 B2
(45) Date of Patent: Oct. 18, 2016

(54) METHOD AND APPARATUS FOR DIGITAL DETECTION OF THE PHASE-CUT ANGLE OF A PHASE-CUT DIMMING SIGNAL

(71) Applicant: KONINKLIJKE PHILIPS N.V., Eindhoven (NL)

(72) Inventor: Maximillan Ben Shaffer, Arlington, MA (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/889,460

(22) PCT Filed: Apr. 24, 2014

(86) PCT No.: PCT/IB2014/060969

§ 371 (c)(1),
(2) Date: Nov. 6, 2015

(87) PCT Pub. No.: WO2014/181210

PCT Pub. Date: Nov. 13, 2014

(65) Prior Publication Data

US 2016/0088700 A1 Mar. 24, 2016

Related U.S. Application Data

(60) Provisional application No. 61/820,964, filed on May 8, 2013.

(51) Int. Cl.
*H05B 33/08* (2006.01)

(52) U.S. Cl.
CPC ..... *H05B 33/0848* (2013.01); *H05B 33/0845* (2013.01)

(58) Field of Classification Search
CPC ..... H05B 33/0815; H05B 33/0848
USPC ..... 315/297, 200 R
See application file for complete search history.

(56) References Cited

U.S. PATENT DOCUMENTS

| | | | |
|---|---|---|---|
| 6,016,038 | A | 1/2000 | Mueller et al. |
| 6,211,626 | B1 | 4/2001 | Lys et al. |
| 6,744,223 | B2 | 6/2004 | Laflamme et al. |
| 7,038,399 | B2 | 5/2006 | Lys et al. |
| 7,847,433 | B2 | 12/2010 | Mancebo del Castillo Pagola |
| 2009/0140666 | A1 | 6/2009 | Liao et al. |
| 2009/0184666 | A1 | 7/2009 | Myers et al. |
| 2010/0134038 | A1 | 6/2010 | Shackle et al. |
| 2010/0301751 | A1 | 12/2010 | Chobot et al. |

(Continued)

FOREIGN PATENT DOCUMENTS

WO 2008112820 A2 9/2008

*Primary Examiner* — Don Le

(57) ABSTRACT

A device (220) implements a method (600) of controlling dimming of a light emitting diode (LED) light source (230) by: receiving a phase-cut dimming signal (105) produced from an AC line voltage (15), ascertaining the peak voltage level (109) of the AC line voltage (15); ascertaining the present value of a phase-cut duty cycle of the phase-cut dimming signal, employing the peak voltage level of the AC line voltage to ascertain the maximum phase-cut duty cycle for the phase-cut dimming signal, ascertaining the phase-cut angle (107) of the phase-cut dimming signal from the present value of the phase-cut duty cycle of the phase-cut dimming signal and the maximum phase-cut duty cycle for the phase-cut dimming signal; and controlling the dimming of the LED light source in response to the phase-cut angle.

16 Claims, 4 Drawing Sheets

(56) References Cited

U.S. PATENT DOCUMENTS

2011/0084622 A1 4/2011 Barrow et al.
2011/0291583 A1 12/2011 Shen
2012/0098454 A1* 4/2012 Grotkowski ..... H05B 33/0815 315/246
2012/0194091 A1 8/2012 Darshan
2013/0187568 A1* 7/2013 Jelaca ..... H05B 37/0263 315/297
2014/0145599 A1* 5/2014 Goscha ..... H01J 65/048 315/34
2014/0312796 A1* 10/2014 Sauerlander ..... H05B 33/0815 315/210
2014/0368109 A1* 12/2014 Goscha ..... H05B 41/3927 315/34

* cited by examiner

METHOD AND APPARATUS FOR DIGITAL DETECTION OF THE PHASE-CUT ANGLE OF A PHASE-CUT DIMMING SIGNAL

CROSS-REFERENCE TO PRIOR APPLICATIONS

This application is the U.S. National Phase application under 35 U.S.C. §371 of International Application No. PCT/IB2014/060969, filed on Apr. 24, 2014, which claims the benefit of U.S. Provisional Patent Application No. 61/820,964, filed on May 8, 2013. These applications are hereby incorporated by reference herein.

TECHNICAL FIELD

The present invention is directed generally to dimmers for lighting units. More particularly, various inventive methods and apparatus disclosed herein relate to digital detection of the phase-cut angle of a phase-cut dimming signal output from an analog phase-cut dimmer.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038 and 6,211,626, incorporated herein by reference.

It is often desirable to provide the capability to controllably dim a lighting unit comprising one of more LED light source by means of a conventional analog dimmer which is employed for an incandescent light source. For example, it is often desirable to continue to employ a dimmer which is already installed in a location for controlling one or more lighting units comprising one or more incandescent light sources, when these lighting units are replaced by lighting units which comprise LED light sources, e.g. as discussed in detail in U.S. Pat. No. 7,038,399, incorporated herein by reference.

Typically, an analog dimmer for incandescent light sources passes a rectified AC voltage to the lighting unit. One common analog dimmer for incandescent light sources is a phase-cut dimmer, sometimes also referred to as a thyristor dimmer as it typically employs a thyristor such as a silicon-controlled rectifier (SCR) or TRIAC. A phase-cut dimmer rectifies an AC line voltage and chops the rectified AC voltage at some phase-cut angle (between 0 and 180 degrees), which represents the amount that the light output of the lighting unit should be dimmed, and provides the chopped AC voltage to the lighting unit as an analog phase-cut dimming signal. Because different countries use different AC line voltages (typically between 90 VAC and 300 VAC) and frequencies (typically 50 Hz or 60 Hz), properties of the phase-cut dimming signal will vary dramatically depending on the locale of the lighting system. When a phase-cut dimmer is connected to a lighting unit having one or more incandescent light sources, it delivers power to the lighting unit which is proportional to the area under the phase-cut dimming signal. Less area means less power, and less power means lower illumination.

However, it is very challenging to interface these analog phase-cut dimmers to lighting units with LED light sources, and particularly to digitally-controlled lighting units with one or more LED light sources which must digitally interpret the analog phase-cut dimming signal and manually control the light output by the LED light source(s) which operate quite differently from incandescent light sources. For example, the light output level of an incandescent light source can be varied by varying the voltage applied to the incandescent light source, while in contrast the light output level of LED light sources is responsive to the current flowing through the LED light sources (which also typically operate at much lower voltage levels than the voltages typically applied to incandescent light sources). The technologies of analog phase-cut dimmers and LED light sources were not designed to be compatible, but in practice they are often used together.

FIG. 1 illustrates an example of an analog phase-cut dimming signal, in particular a reverse phase-cut dimming signal 105 (also referred to as a trailing edge dimming signal), wherein the rectified AC line voltage (peak value 109=120V) has been cut at a phase-cut angle 107 of 130 degrees until the end of each half cycle (i.e. cut on the right side of the waveform). If phase-cut dimming signal 105 were applied to an incandescent light source, the light output would be approximately 72% of its full intensity. Although FIG. 1 illustrates an example waveform of a reverse phase-cut dimming signal 105, some analog phase-cut dimmers produce a phase-cut dimming signal where the AC line voltage has been cut from the left side of the waveform (i.e., from the start of each half cycle until a particular phase-cut angle), which is called a forward phase-cut dimming signal (also referred to as a leading edge dimming signal). For simplicity and consistency, the descriptions to follow will employ the example of reverse phase-cut dimming. However, it should be understood that the principles involved also apply to forward phase-cut dimming.

The dimming angle 107 of phase-cut dimming signal 105 is related to the pulse width of the phase-cut AC waveform (i.e., for a reverse phase-cut dimming signal the width of the phase-cut dimming signal between the start of each half cycle and the phase-cut edge). Using this information, phase-cut angle 107 can be calculated using the following equation:

$$\text{phase_cut_angle(degrees)}=(\text{dimming_signal_pulse_width}/\text{dimming_signal_period})*180 \quad (1)$$

In practice however, analog phase-cut dimmers often do not provide a very "clean" phase-cut dimming signal to a lighting unit. The phase-cut dimming signal may be distorted or ride on a DC bias. Each analog phase-cut dimmer outputs a slightly different waveform, which makes it difficult for a microcontroller in a lighting unit comprising one or more LED light sources to decipher the phase-cut angle so that a signal can be generated for dimming the light output of the LED light sources by the appropriate amount.

Because of this problem, many controllers for lighting units comprising one or more LED light sources estimate the phase-cut angle, but do not attempt to measure the phase-cut angle precisely. As a result, the lighting units may act differently from phase-cut dimmer to phase-cut dimmer, which is not desirable. Thus, there is a need in the art for a method and apparatus for more accurate detection of the phase-cut angle of a phase-cut dimming signal.

SUMMARY

The present disclosure is directed to inventive methods and apparatus for detecting the phase-cut angle of a phase-cut dimming signal. For example, methods and devices are provided for digitally detecting the phase-cut angle of a phase-cut dimming signal so that a signal can be generated for dimming the light output of the LED light sources by the appropriate amount.

Generally, in one aspect, the invention relates to a method, including: receiving a phase-cut dimming signal produced from an AC line voltage; comparing the phase-cut dimming signal to a threshold voltage and in response thereto outputting a digital phase-cut dimming signal; ascertaining a peak voltage level of the AC line voltage; ascertaining a duty cycle of the digital phase-cut dimming signal; employing the peak voltage level of the AC line voltage to ascertain a maximum value of the duty cycle of the digital phase-cut dimming signal; ascertaining a phase-cut angle of the phase-cut dimming signal from the duty cycle of the digital phase-cut dimming signal and the maximum value of the duty cycle of the digital phase-cut dimming signal; and controlling a dimming of an LED-based lighting unit in response to the phase-cut angle of the phase-cut dimming signal.

In some embodiments, employing the peak voltage level of the AC line voltage to ascertain the maximum value of the duty cycle of the digital phase-cut dimming signal comprises obtaining the maximum value of the duty cycle of the digital phase-cut dimming signal corresponding to the peak voltage level of the AC line voltage from a look-up table comprising a plurality of table entries, wherein each table entry corresponds to a particular value of the peak voltage level of the AC line voltage and stores data identifying a corresponding particular maximum value of the duty cycle of the phase-cut dimming signal In some embodiments, ascertaining the peak voltage level of the AC line voltage comprises: ascertaining a derivative of the phase-cut dimming signal; ascertaining whether the derivative of the phase-cut dimming signal crosses zero; and when it is ascertained that the derivative of the phase-cut dimming signal crosses zero, finding the peak voltage level of the AC line voltage as a peak voltage level of the phase-cut dimming signal.

In some versions of these embodiments, when it is ascertained that the derivative of the phase-cut dimming signal does not cross zero, retrieving the peak voltage level of the AC line voltage from memory.

In some embodiments, ascertaining a peak voltage level of the AC line voltage comprises: ascertaining a derivative of the phase-cut dimming signal; ascertaining whether the derivative of the phase-cut dimming signal crosses zero; and when it is ascertained that the derivative of the phase-cut dimming signal crosses zero, finding the peak voltage level of the AC line voltage as a voltage level of the phase-cut dimming signal at a time when the derivative of the phase-cut dimming signal crosses zero.

In some embodiments, controlling the dimming of the LED-based lighting unit in response to the phase-cut angle comprises ascertaining a ratio of an area under a voltage waveform of the phase-cut dimming signal to an area under a voltage waveform of the AC line voltage after rectification, and dimming the LED-based lighting unit according to the ratio.

In some embodiments, controlling the dimming of the LED-based lighting unit in response to the phase-cut angle comprises looking up a dimming percentage for the LED-based lighting unit in a look-up table comprising a plurality of table entries each corresponding to a different value of the phase-cut angle and a corresponding different value for the dimming percentage.

In some embodiments, the method further comprises: for each of a plurality of values for the peak voltage level of the AC line voltage, measuring a corresponding maximum value of the duty cycle of the digital phase-cut dimming signal; and storing each of the corresponding maximum values of the duty cycle of the digital phase-cut dimming signal for each of the plurality of values for the peak voltage level in a corresponding table entry of a look-up table in a memory device.

In another aspect, the invention relates to an apparatus including: an input configured to receive a phase-cut dimming signal produced from an AC line voltage; a comparator configured to compare the phase-cut dimming signal to a threshold voltage and in response thereto to output a digital phase-cut dimming signal; and a processor. The processor is configured to: ascertain a peak voltage level of the AC line voltage; ascertain a duty cycle of the digital phase-cut dimming signal; employ the peak voltage level of the AC line voltage to ascertain a maximum value of the duty cycle of the digital phase-cut dimming signal; ascertain a phase-cut angle of the phase-cut dimming signal from the duty cycle of the digital phase-cut dimming signal and the maximum value of the duty cycle of the digital phase-cut dimming signal; and control a dimming of an LED-based lighting unit in response to the phase-cut angle.

In some embodiments, a memory device having stored therein a look-up table comprising a plurality of table entries, wherein each table entry corresponds to a particular value of the peak voltage level of the AC line voltage and stores data identifying a corresponding particular maximum value of the duty cycle of the phase-cut dimming signal.

In some embodiments, the processor is configured to ascertain the peak voltage level of the AC line voltage by: ascertaining a derivative of the phase-cut dimming signal; ascertaining whether the derivative of the phase-cut dimming signal crosses zero; and when it is ascertained that the derivative of the phase-cut dimming signal crosses zero, finding the peak voltage level of the AC line voltage as a peak voltage level of the phase-cut dimming signal.

In some versions of these embodiments, the processor is further configured such that when it ascertains that the derivative of the phase-cut dimming signal does not cross zero, the processor retrieves the peak voltage level of the AC line voltage from memory.

In some embodiments, the processor is configured to ascertain the peak voltage level of the AC line voltage by: ascertaining a derivative of the phase-cut dimming signal; ascertaining whether the derivative of the phase-cut dimming signal crosses zero; and when it is ascertained that the derivative of the phase-cut dimming signal crosses zero, finding the peak voltage level of the AC line voltage as a voltage level of the phase-cut dimming signal at a time when the derivative of the phase-cut dimming signal crosses zero.

In some embodiments, the processor controls the dimming of the LED-based lighting unit by ascertaining a ratio of an area under a voltage waveform of the phase-cut dimming signal to an area under a voltage waveform of the AC line voltage after rectification, and outputting an LED dimming signal for dimming the LED-based lighting unit according to the ratio.

In some embodiments, the processor controls the dimming of the LED-based lighting unit by looking up a dimming percentage for the LED-based lighting unit in a look-up table comprising a plurality of table entries each corresponding to a different value of the phase-cut angle and a corresponding value for the dimming percentage.

In some embodiments, the apparatus further comprises: further comprising a memory device having stored therein a look-up table comprising a plurality of data entries. The apparatus is configured, for each of a plurality of particular values for the peak voltage level of the AC line voltage, to: measure a corresponding maximum value of the maximum duty cycle of the digital phase-cut dimming signal; and store each of the corresponding maximum values of the duty cycle of the digital phase-cut dimming signal in one of the table entries for the particular value of the peak voltage level of the AC line voltage.

In yet another aspect, the invention relates to a method, including: receiving an analog phase-cut dimming signal produced from an AC line voltage; generating a digital phase-cut dimming signal from the analog phase-cut dimming signal; employing the digital phase-cut dimming signal to ascertain a phase-cut angle of the analog phase-cut dimming signal; and controlling a dimming of an LED-based lighting unit in response to the phase-cut angle of the analog phase-cut dimming signal.

In some embodiments, the digital phase-cut signal has a first value when a voltage of the analog phase-cut dimming signal is greater than a threshold voltage and has a second value when the voltage of the analog phase-cut dimming signal is less than the threshold voltage.

In some embodiments, the phase-cut angle of the analog phase-cut dimming signal is ascertained from a peak voltage level of the AC line voltage, and one of: a duty cycle of the digital phase-cut dimming signal, and a pulse width of the digital phase-cut dimming signal.

In some embodiments, ascertaining the peak voltage level of the AC line voltage from a zero-crossing of a derivative of the analog phase-cut dimming signal.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers).

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources, including one or more LEDs as defined above. A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, EEPROM and FLASH memory, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Because analog phase-cut dimmers often do not provide a very "clean" phase-cut dimming signal to the lighting unit, each analog phase-cut dimmer outputs a slightly different waveform, which makes it difficult for a controller for a lighting unit comprising one or more LED light sources to decipher the phase-cut angle so that a signal can be generated for dimming the light output of the LED light sources by the appropriate amount. Because of this problem, many controllers estimate the phase-cut angle, but do not attempt to determine the phase-cut angle precisely, as a result of which the lighting unit may act differently from phase-cut dimmer to phase-cut dimmer, which is not desirable. More generally, Applicants recognized and appreciated that it would be beneficial to provide a method and apparatus for more accurate detection of the phase-cut angle of a phase-cut dimming signal.

In view of the foregoing, various embodiments and implementations of the present invention are directed to inventive methods and apparatuses for detecting the phase-cut angle of a phase-cut dimming signal. For example, methods and apparatuses are provided for digitally detecting the phase-cut angle of a phase-cut dimming signal so that a signal can be generated for dimming the light output of the LED light sources by the appropriate amount.

Figure 2:
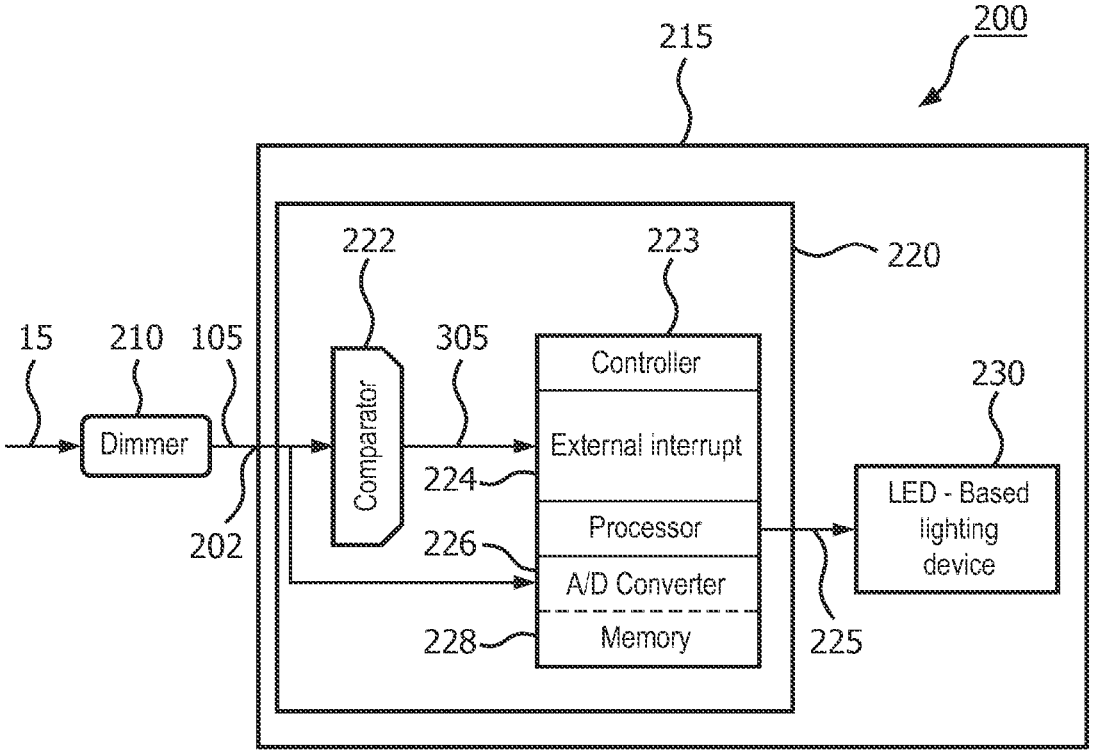
FIG. 2 is a functional block diagram of an example embodiment of alighting system including an apparatus for detecting the phase-cut angle of a phase-cut dimming signal.

FIG. 2 is a functional block diagram of an example embodiment of a lighting system 200. Lighting system 200 includes an analog phase-cut dimmer 210 and an LED-based lighting unit 215. LED-based lighting unit 215 includes a phase-cut angle detection apparatus 220 and an LED-based lighting device 230.

Figure 1:
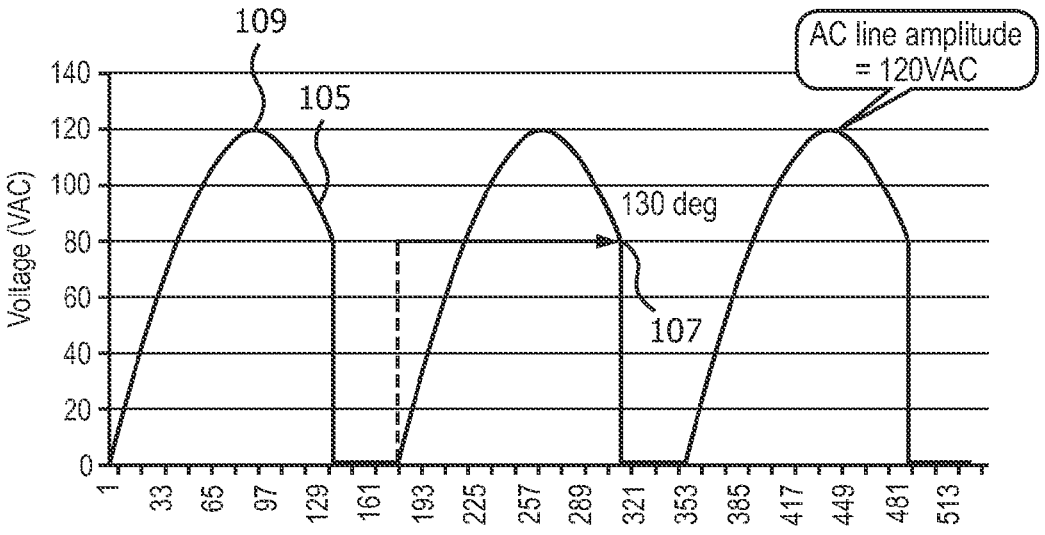
FIG. 1 illustrates an example of an analog trailing edge, or reverse phase-cut, dimming signal.

Analog phase-cut dimmer 210 receives an AC line voltage 15, rectifies AC line voltage 15, and outputs an analog phase-cut dimming signal 105, which may be a reverse phase-cut dimming signal (also referred to as a trailing edge dimming signal), or a forward phase-cut dimming signal (also referred to as a leading edge dimming signal) as described above with respect to FIG. 1. For simplicity and consistency of explanation, the example operations and methods described below and illustrated in the drawings employ a reverse phase-cut dimming signal. However, it should be understood that the principles involved and the described methods also may apply to a forward phase-cut dimming signal.

Phase-cut angle detection apparatus 220 includes a comparator 222 and a controller 230. Controller 230 includes a processor 224, an analog-to-digital (A/D) converter (ADC) 226, and a memory device 228. Controller 230 may include other devices, such as digital logic circuits, buffers, drivers, programmable logic devices, etc. not specifically shown in FIG. 2. Processor 224 may be configured to execute one or more methods, operations or algorithms in response to processor instruction code which may be stored, for example, in memory device 228, including methods described herein, for example with respect to FIG. 6. Memory device 228 may include volatile memory (e.g., random access memory) and/or non-volatile memory, such as ROM, PROM, EEPROM, FLASH memory, etc. Memory device 228 may store therein one or more computer programs for execution by processor 224.

LED-based lighting device 230 includes one or more LED light sources. In some embodiments, LED-based lighting device 230 may also include driver circuitry for properly formatting and supplying power to drive and illuminate the LED sources, and/or circuitry for dimming the light output by such LED sources. For example, it is common to drive LED sources via a controlled current source, and LED-based lighting device 230 may include one or more such controlled current sources.

It should be understood that FIG. 2 illustrates relationships between various functional components and should be interpreted as illustrating any particular physical arrangement of components. In particular, in some embodiments phase-cut angle detection apparatus 220 may be distinct from and/or physically separated from the rest of LED-based lighting unit 215. Furthermore, in some embodiments one or more functions of dimming angle detection apparatus 220 and one or more functions of LED-based lighting device 230 (e.g., LED driver and/or LED dimming functions) may be performed by one or more shared components in LED-based lighting unit 215.

Operations of lighting system 200, and particularly phase-cut angle detection apparatus 220, will now be described with respect to FIGS. 3-6.

In operation, analog phase-cut dimmer 210 outputs analog phase-cut dimming signal 105 (e.g., a reverse phase-cut dimming signal) to an input 102 of LED-based lighting unit 215. Phase-cut angle detection apparatus 220 receives analog phase-cut dimming signal 105 and in response thereto is configured to output one or more dimming control signals 225 for controlling a light output level of the LED light source(s) of LED-based lighting unit 215 according to the amount of dimming indicated by phase-cut angle 107 of analog phase-cut dimming signal 105.

In particular, in response to analog phase-cut dimming signal 105, phase-cut angle detection apparatus 220 produces a digital phase-cut dimming signal 305. More specifically, comparator 222 receives analog phase-cut dimming signal 105, compares analog phase-cut dimming signal 105 to a threshold, (e.g., 10 volts) and in response to the comparison outputs digital phase-cut dimming signal 305. Digital phase-cut dimming signal 305 has a first state, voltage, or logic value (e.g., "1") when analog phase-cut dimming signal 105 is greater than the threshold, and which has a second state, voltage, or logic value (e.g., "0") when analog phase-cut dimming signal 105 is less than the threshold.

Figure 3:
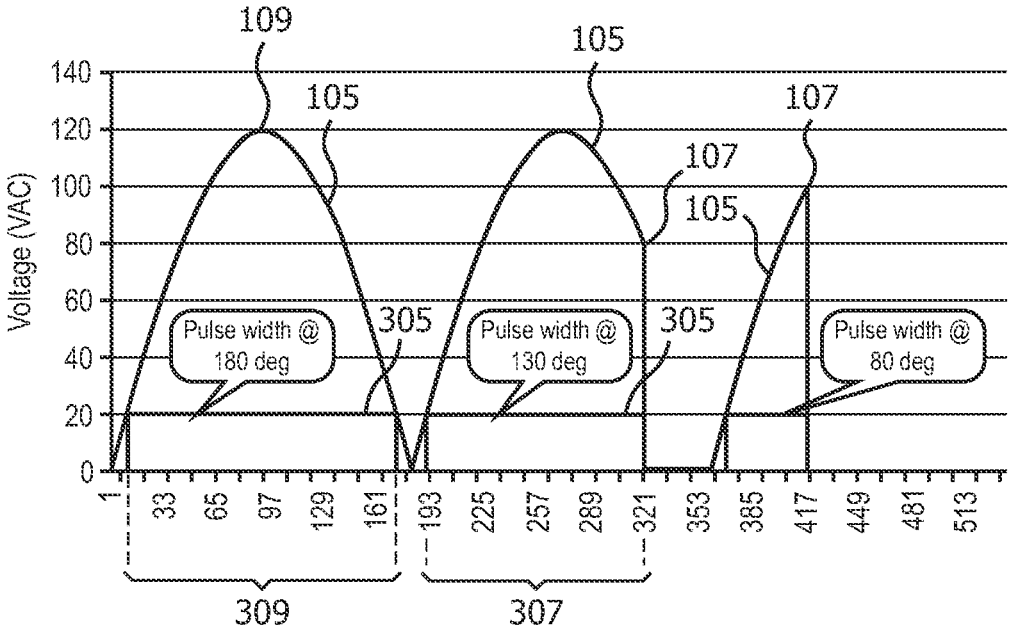
FIG. 3 illustrates examples of an analog trailing edge, or reverse phase-cut, dimming signal and a corresponding digital phase-cut dimming signal which may be produced therefrom.

FIG. 3 illustrates examples of analog phase-cut dimming signal 105 and a corresponding digital phase-cut dimming signal 305 which may be produced therefrom by a phase-cut angle detection apparatus, and in particular by phase-cut angle detection apparatus 220. FIG. 3 illustrates three different cases for three different phase-cut angles 107.

At the far left is illustrated a case where phase-cut angle 107 is 180 degrees, i.e., there is no dimming. In that case, analog phase-cut dimming signal 105 is the same as the rectified AC line voltage 301 which in this example has a peak voltage level 109 of 120 volts. In the middle is illustrated a case where phase-cut angle 107 is 130 degrees, and at the right is illustrated a case where phase-cut angle 107 is 80 degrees. In each case, phase-cut angle detection apparatus 220 produces from phase-cut dimming signal 105 a corresponding digital phase-cut dimming signal 305 which as only two values: a first value (e.g., "1") when analog phase-cut dimming signal 105 exceeds a threshold, and second value (e.g., "0") when analog phase-cut dimming signal 105 does not exceed the threshold.

As can be seen from FIG. 3, digital phase-cut signal 305 is a pulsed signal which has a period which is equal to a half wave of rectified AC line voltage 301, and a pulse width 307 which varies according to phase-cut angle 107, from a minimum value of zero or near zero when phase-cut angle 107 is near zero degrees (light output is turned completely OFF) to a maximum value 309 when phase-cut angle 107 is 180 degrees (light output is turned completely ON). In Accordingly, equation (1) above may be rewritten to calculate phase-cut angle 107 of analog phase-cut dimming signal 105 by means of digital phase-cut signal pulse width 307 as:

$$\text{phase_cut_angle (degrees)} = 180 * \left( \frac{\text{digital_phase_cut_signal_pulse_width}}{\text{maximum_value_digital_phase_cut_signal_pulse_width}} \right) \quad (2)$$

Beneficially, controller 223, and specifically processor 224, can easily measure digital phase-cut signal pulse width 307 of digital phase-cut dimming signal 305. Furthermore, for a given threshold voltage, maximum value 309 of the pulse width of digital phase-cut dimming signal 305 (i.e., the pulse width when phase-cut angle 107 is 180 degrees) is a function of peak voltage level 109 ($V_{AC}$) of AC line voltage 15, and the frequency $F_{AC}$ of AC line voltage 15:

$$\text{maximum_value_digital_phase_cut_signal_pulse_width} = f(V_{AC} F_{AC}) \quad (3)$$

Phase-cut angle detection apparatus 220 (and specifically processor 224) could measure maximum value 309 of the pulse width of digital phase-cut dimming signal 305 for various combinations of values of $V_{AC}$ and $F_{AC}$ (e.g., common voltage levels such as 110 V, 120 V, 220 V, 230 V, 50 Hz, 60 Hz, etc.) in a calibration procedure, and store the maximum values in a look-up table in memory (e.g., memory device 228). Then, in operation, processor 224 could measure digital phase-cut signal pulse width 307 (for example, using a timer), determine peak voltage level 109 and the operating frequency $F_{AC}$ of AC line voltage 15, use peak voltage level 109 and the operating frequency $F_{AC}$ of AC line voltage 15 to retrieve maximum value 309 of the pulse width of digital phase-cut dimming signal 305, and determine phase-cut angle 107 of analog dimming signal 105 from equation (2).

The inventor has further noted that the ratio of digital phase-cut signal pulse width 307 to maximum value 309 of the pulse width (i.e., the duty cycle of digital phase-cut dimming signal 305) does not change with, and is not a function of, the AC line frequency $F_{AC}$. That is:

$$\text{maximum_value_digital_phase_cut_signal_duty_cylce} = f(V_{AC}) \quad (4)$$

Accordingly, the look-up table can be simplified to eliminate $F_{AC}$ by working with duty cycles instead of absolute pulse widths. In that case, phase-cut angle 107 of analog phase-cut dimming signal 105 may be calculated as:

$$\text{phase_cut_angle (degrees)} = 180 * \left( \frac{\text{digital_phase_cut_signal_duty_cycle}}{\text{maximum_value_digital_phase_cut_signal_duty_cycle}} \right) \quad (5)$$

Phase-cut angle detection apparatus 220 (and specifically processor 224) can measure the maximum value of the duty cycle of digital phase-cut dimming signal 305 for a plurality of peak voltage levels 109 of AC line voltage 15, for example including, common voltage levels such as 110 V, 120 V, 220 V, 230 V, etc.) in a calibration procedure, and store each of the maximum values in a corresponding entry in a look-up table in memory (e.g., memory device 228), wherein each entry corresponds to one of the plurality of peak voltage levels 109. In some embodiments, the look-up table may be indexed by the peak voltage levels 109 of AC line voltage 15. Then, in operation, processor 224 could determine the phase-cut angle from the duty cycle of digital phase-cut dimming signal 305 (for example, using a timer), retrieve the maximum value of the duty cycle from a look-up table, and use the duty cycle of digital phase-cut dimming signal 305 and the maximum value of the duty cycle to determine phase-cut angle 107 of analog phase-cut dimming signal 105 by employing equation (5).

To retrieve the maximum value of the duty cycle from the look-up table, processor 224 needs to know peak voltage level 109 of AC line voltage 15.

However phase-cut angle detection apparatus 220 does not receive AC line voltage 15. So phase-cut angle detection apparatus 220 must ascertain peak voltage level 109 of AC line voltage 15 from analog phase-cut dimming signal 105.

To ascertain peak voltage level 109 of AC line voltage 15 from analog phase-cut dimming signal 105, there are two possible cases, depending on phase-cut angle 107 itself.

The first case is when phase-cut angle 107 is 90 degrees or greater. In that case, then the peak voltage level of analog phase-cut dimming signal 105 is the same as peak voltage level 109 of AC line voltage 15. In that case, the peak voltage level 109 of AC line voltage 15 may be determined by finding the peak or maximum value of analog phase-cut dimming signal 105. Toward that end, as illustrated in FIG. 2 analog phase-cut dimming signal 105 is provided to the input of ADC 226 of controller 223. ADC 226 outputs a digital word which depends on the voltage level of the input analog phase-cut dimming signal 105, and processor 224 finds the peak or maximum value of analog phase-cut dimming signal 105, and therefore the peak voltage level 109 of AC line voltage 15, from the ADC output.

The second case is when phase-cut angle 107 is less than 90 degrees.

Figure 4:
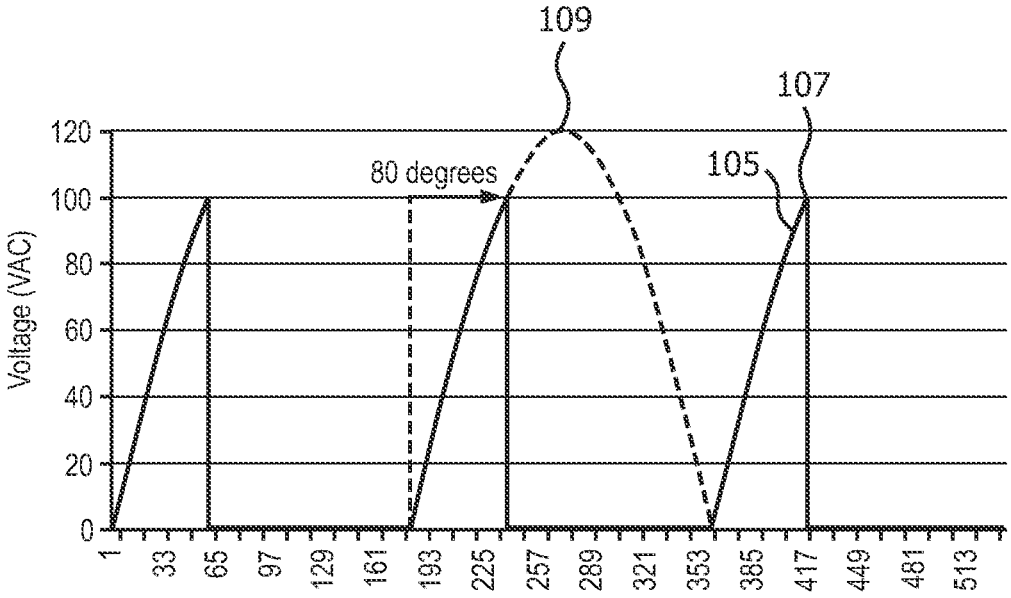
FIG. 4 illustrates another example of an analog trailing edge, or reverse phase-cut, dimming signal.

FIG. 4 illustrates an example of an analog trailing edge, or reverse phase-cut, dimming signal, when phase-cut angle 107 is less than 90 degrees, and in particular is 80 degrees. As is illustrated in FIG. 4, when phase-cut angle 107 is less than 90 degrees then peak voltage level 109 of AC line voltage 15 is chopped off, and analog phase-cut dimming signal 105 never reaches peak voltage level 109 of AC line voltage 15. Accordingly, peak voltage level 109 of AC line voltage 15 cannot be ascertained from the current cycle of analog phase-cut dimming signal 105 when phase-cut angle 107 in the current cycle of analog phase-cut dimming signal 105 is less than 90 degrees. In that case, peak voltage level 109 of AC line voltage 15 instead may be determined from a previous cycle of analog phase-cut dimming signal 105 when phase-cut angle 107 was 90 degrees or greater (for example, from a value stored in memory device 228 during an earlier cycle of analog phase-cut dimming signal 105 when phase-cut angle 107 was 90 degrees or greater).

Thus it is seen that a certain apparent paradox exists wherein, to ascertain phase-cut angle 107, processor 224 needs to know peak voltage level 109 of AC line voltage 15, but in order to correctly ascertain peak voltage level 109 of AC line voltage 15, processor 224 needs to know that phase-cut angle 107 is at least 90 degrees.

Although processor 224 may not know peak voltage level 109 of AC line voltage 15, it is known that the waveform of AC line voltage 15 is a sine wave, and that the waveform of analog phase-cut dimming signal 105 is a chopped rectified sine wave. Furthermore, it is known that the peak level of a sine wave occurs at a point where the derivative of the sine wave is zero (a zero crossing point).

Figure 5:
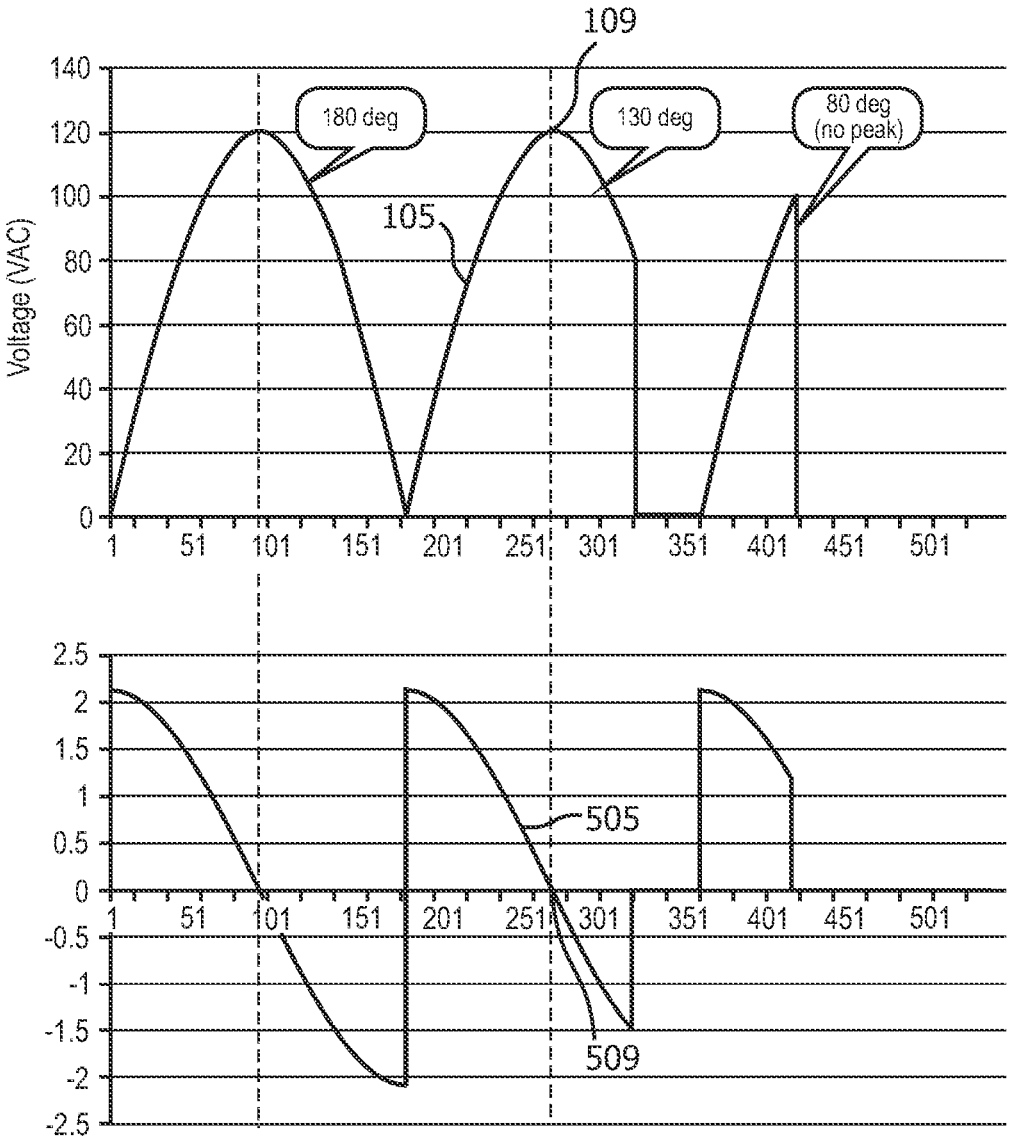
FIG. 5 illustrates relationships between an analog trailing edge, or reverse phase-cut, dimming signal and a corresponding derivative of the analog reverse phase-cut dimming signal.

FIG. 5 illustrates relationships between an analog trailing edge, or reverse phase-cut, dimming signal 105 and a corresponding derivative 505 of the analog reverse phase-cut dimming signal. The top of FIG. 5 illustrates examples of analog phase-cut dimming signal 105 for three different phase-cut angles 107. At the far left of FIG. 5 is illustrated a case where phase-cut angle 107 is 180 degrees, in the middle is illustrated a case phase-cut angle 107 is 130 degrees, and at the right is illustrated a case where phase-cut angle 107 is 80 degrees. The bottom of FIG. 5 illustrates the derivative 505 for each of the examples of analog phase-cut dimming signal 105 corresponding to the three different phase-cut angles 107.

From FIG. 5 it can be seen that if derivative 505 of analog phase-cut dimming signal 105 crosses zero (i.e., has a zero crossing point 509), then analog phase-cut dimming signal 105 does have a peak and therefore phase-cut angle is 90 degrees or greater. In that case, as noted above, the peak voltage level of analog phase-cut dimming signal 105 is the same as peak voltage level 109 of AC line voltage 15, and processor 224 may ascertain peak voltage level 109 of AC line voltage 15 from the peak voltage level of analog phase-cut dimming signal 105 as ascertained from the output of ADC 226. Alternatively, processor 224 may ascertain peak voltage level 109 of AC line voltage 15 from the output of ADC 226 at the time of zero crossing 509 in derivative 505.

On the other hand, if derivative 505 of analog phase-cut dimming signal 105 does not cross zero, then analog phase-cut dimming signal 105 does not have a peak and therefore phase-cut angle 107 is less than 90 degrees. In that case, as noted above, peak voltage level 109 of AC line voltage 15 cannot be ascertained from a current cycle of analog phase-cut dimming signal 105, and instead must be ascertained from the peak voltage level of analog phase-cut dimming signal 105 in an earlier cycle when phase-cut angle 107 was 90 degrees or greater (i.e., when analog phase-cut dimmer 210 was set to provide a greater level of illumination by LED-based lighting device 230). In some embodiments, peak voltage level 109 of AC line voltage 15 may be obtained from a value stored in a memory device (e.g., memory device 228) which value was obtained during such an earlier cycle of analog phase-cut dimming signal 105. AC line voltage 15 may be expected to vary relatively little over time once LED-based lighting unit 215 is installed in a particular installation, so using a previously-obtained value will still allow phase-cut angle detection apparatus 220 to obtain a good value for phase-cut angle 107 even when phase-cut angle 107 is less than 90 degrees. In some embodiments, peak voltage level 109 of AC line voltage 15 may be stored in a nonvolatile memory device, such as a FLASH memory device of phase-cut angle detection apparatus 220, which may be included in memory device 228.

In the event that peak voltage level 109 of AC line voltage 15 from an earlier cycle of analog phase-cut dimming signal 105 when phase-cut angle 107 was 90 degrees or greater is not available (e.g., the first time that phase-cut angle detection apparatus 220 is powered-on), then in some embodiments processor 224 may be configured to output one or more dimming control signals which completely turn off the LED light sources of LED-based lighting unit 215. This in turn may cause a user to adjust dimmer 210 to increase the light level by making phase-cut angle 107 greater than 90 degrees, at which point the peak voltage level of analog phase-cut dimming signal 105 may be ascertained as explained above and stored in memory (e.g., memory 228).

Once phase-cut angle 107 of analog phase-cut dimming signal 105 is known, controller 223 may use that information to produce one or more dimming control signals 225 for controlling the light output level of the LED light source(s) of LED-based lighting unit 215 according to the amount of dimming indicated by phase-cut angle 107.

For example, from knowledge of phase-cut angle 107, processor 224 may ascertain the ratio of the area under a voltage waveform of phase-cut dimming signal 105 to an area under the voltage waveform of AC line voltage 15 after rectification, and dim the LED light source(s) of LED-based lighting unit 215 according to the ratio.

In some embodiments, controller 223 may control the dimming of LED-based lighting unit 215 by accessing a look-up table having a plurality of entries, each entry corresponding to a different particular phase-cut angle 107 and having stored therein data indicating a dimming percentage or amount of dimming to be applied to the LED light sources of LED-based lighting unit 215.

Figure 6:
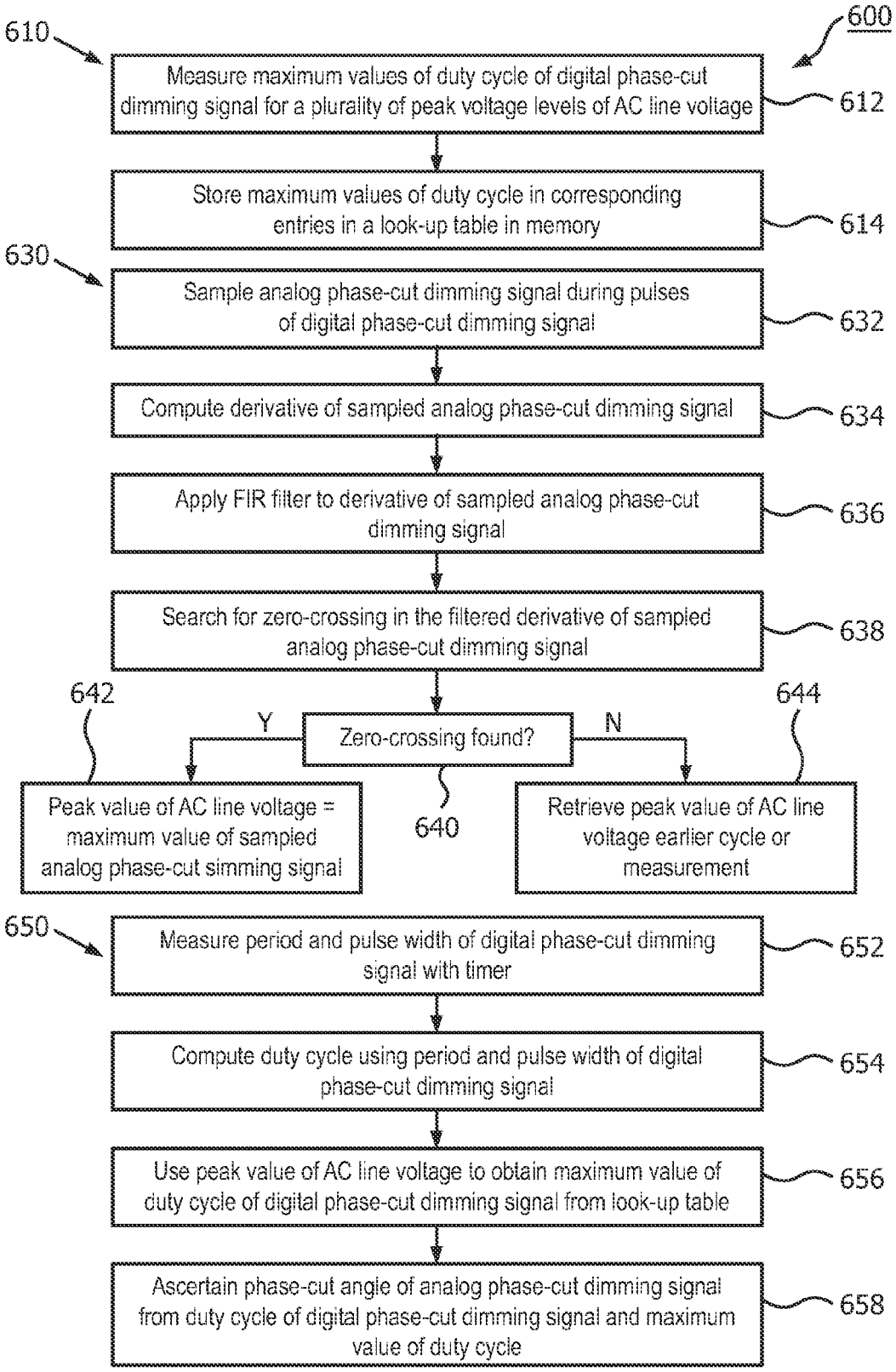
FIG. 6 illustrates a flowchart of an example embodiment of a method of detecting the phase-cut angle of a phase-cut dimming signal.

FIG. 6 illustrates a flowchart of an example embodiment of a method 600 of detecting the phase-cut angle of a phase-cut dimming signal. Method 600 is divided into three major operations 610, 630 and 650. Operation 610 is an example embodiment of a calibration operation or procedure for phase-cut angle detection apparatus 220. Operation 630 is an example embodiment of an operation or method of determining peak value 109 of AC line voltage 15. Operation 650 is an example embodiment of an operation or method of determining phase-cut angle 107 of analog phase-cut dimming signal 105.

In a step 612, phase-cut angle detection apparatus 220 measures maximum values of duty cycle of digital phase-cut dimming signal 305 for a plurality of peak voltage levels 109 of AC line voltage 15 with dimming angle 107 of analog phase-cut dimming signal 105 at 180 degrees (i.e., minimal or no dimming; full illumination).

In a step 614, processor 224 stores the maximum values of the duty cycle of digital phase-cut dimming signal 305 in corresponding entries in a look-up table in memory (e.g., memory device 228), where each entry corresponds to a particular value of peak voltage level 109.

In a step 632, phase-cut angle detection apparatus 220 samples analog phase-cut dimming signal 105 during pulses of digital phase-cut dimming signal 305 (i.e., at times when analog phase-cut dimming signal 105 is greater than the threshold voltage of comparator 222. Analog phase-cut dimming signal 105 may be sampled by ADC 226 of controller 223.

In a step 634, processor 224 computes derivative 505 of the sampled analog phase-cut dimming signal 105.

In a step 636, controller 223 filters derivative 505 of the sampled analog phase-cut dimming signal 105 to reduce noise in the signal. In some embodiments, a finite impulse response (FIR) filter is employed. In some embodiments, step 636 may be omitted.

In a step 638, processor 224 searches for a zero-crossing 509 in the filtered derivative 505 of the sampled analog phase-cut dimming signal 105.

In a step 640, processor 224 determines whether a zero crossing 509 is found.

If a zero crossing 509 is found, then in a step 642 processor 224 ascertains peak value 109 of AC line voltage 15 to be equal to the maximum value of sampled analog phase-cut dimming signal 105.

If a zero crossing 509 is not found, then in a step 644 processor 224 retrieves peak value 109 of AC line voltage 15 from an earlier cycle or measurement of analog phase-cut dimming signal 105 for example stored in memory (e.g., memory device 228).

In a step 652, LED-based lighting unit 215 receives at its input 102 phase-cut dimming signal 105 produced from AC line voltage 15, compares phase-cut dimming signal 105 to a threshold voltage, in response thereto outputs digital phase-cut dimming signal 305, and processor 224 measures the period and pulse width of digital phase-cut dimming signal 305, for example with a timer.

In a step 654, processor 224 computes the duty cycle of digital phase-cut dimming signal 305 using the period and pulse width of digital phase-cut dimming signal 305.

In a step 656, processor 224 use peak value 109 of AC line voltage 15 to obtain the maximum value of the duty cycle of digital phase-cut dimming signal 305, for example from a look-up table stored in memory (e.g., memory device 228).

In a step 658, processor 224 ascertains phase-cut angle 107 of analog phase-cut dimming signal 105 from the duty cycle of digital phase-cut dimming signal 305 and the maximum value of the duty cycle digital phase-cut dimming signal 305.

Once processor 224 has ascertained phase-cut angle 107 of analog phase-cut dimming signal 105, it may use that information to produce one or more dimming control signals 225 for controlling the light output level of the LED light source(s) of LED-based lighting unit 215 according to the amount of dimming indicated by phase-cut angle 107.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

It should also be understood that, unless clearly indicated to the contrary, in any methods claimed herein that include more than one step or act, the order of the steps or acts of the method is not necessarily limited to the order in which the steps or acts of the method are recited. Also, reference numerals appearing in the claims between parentheses are provided merely for convenience and should not be construed as limiting the claims in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A method, comprising:

receiving a phase-cut dimming signal produced from an AC line voltage;

comparing the phase-cut dimming signal to a threshold voltage and in response thereto outputting a digital phase-cut dimming signal;

ascertaining a peak voltage level of the AC line voltage;

ascertaining a duty cycle of the digital phase-cut dimming signal;

employing the peak voltage level of the AC line voltage to ascertain a maximum value of the duty cycle of the digital phase-cut dimming signal;

ascertaining a phase-cut angle of the phase-cut dimming signal from the duty cycle of the digital phase-cut dimming signal and the maximum value of the duty cycle of the digital phase-cut dimming signal; and controlling a dimming of an LED-based lighting unit in response to the phase-cut angle of the phase-cut dimming signal.

2. The method of claim 1, wherein employing the peak voltage level of the AC line voltage to ascertain the maximum value of the duty cycle of the digital phase-cut dimming signal comprises obtaining the maximum value of the duty cycle of the digital phase-cut dimming signal corresponding to the peak voltage level of the AC line voltage from a look-up table comprising a plurality of table entries, wherein each table entry corresponds to a particular value of the peak voltage level of the AC line voltage and stores data identifying a corresponding particular maximum value of the duty cycle of the phase-cut dimming signal.

3. The method of claim 1, wherein ascertaining the peak voltage level of the AC line voltage comprises:

ascertaining a derivative of the phase-cut dimming signal;

ascertaining whether the derivative of the phase-cut dimming signal crosses zero; and when it is ascertained that the derivative of the phase-cut dimming signal crosses zero, finding the peak voltage level of the AC line voltage as a peak voltage level of the phase-cut dimming signal.

4. The method of claim 3, wherein when it is ascertained that the derivative of the phase-cut dimming signal does not cross zero, retrieving the peak voltage level of the AC line voltage from memory.

5. The method of claim 1, wherein ascertaining a peak voltage level of the AC line voltage comprises:

ascertaining a derivative of the phase-cut dimming signal;

ascertaining whether the derivative of the phase-cut dimming signal crosses zero; and when it is ascertained that the derivative of the phase-cut dimming signal crosses zero, finding the peak voltage level of the AC line voltage as a voltage level of the phase-cut dimming signal at a time when the derivative of the phase-cut dimming signal crosses zero.

6. The method of claim 1, wherein controlling the dimming of the LED-based lighting unit in response to the phase-cut angle comprises ascertaining a ratio of an area under a voltage waveform of the phase-cut dimming signal to an area under a voltage waveform of the AC line voltage after rectification, and dimming the LED-based lighting unit according to the ratio.

7. The method of claim 1, wherein controlling the dimming of the LED-based lighting unit in response to the phase-cut angle comprises looking up a dimming percentage for the LED-based lighting unit in a look-up table comprising a plurality of table entries each corresponding to a different value of the phase-cut angle and a corresponding different value for the dimming percentage.

8. The method of claim 1, further comprising:

for each of a plurality of values for the peak voltage level of the AC line voltage, measuring a corresponding maximum value of the duty cycle of the digital phase-cut dimming signal; and storing each of the corresponding maximum values of the duty cycle of the digital phase-cut dimming signal for each of the plurality of values for the peak voltage level in a corresponding table entry of a look-up table in a memory device.

9. An apparatus, comprising:

an input configured to receive a phase-cut dimming signal produced from an AC line voltage;

a comparator configured to compare the phase-cut dimming signal to a threshold voltage and in response thereto to output a digital phase-cut dimming signal; and a processor configured to:

ascertain a peak voltage level of the AC line voltage;

ascertain a duty cycle of the digital phase-cut dimming signal;

employ the peak voltage level of the AC line voltage to ascertain a maximum value of the duty cycle of the digital phase-cut dimming signal;

ascertain a phase-cut angle of the phase-cut dimming signal from the duty cycle of the digital phase-cut dimming signal and the maximum value of the duty cycle of the digital phase-cut dimming signal; and control a dimming of an LED-based lighting unit in response to the phase-cut angle.

10. The apparatus of claim 9, further comprising a memory device having stored therein a look-up table comprising a plurality of table entries, wherein each table entry corresponds to a particular value of the peak voltage level of the AC line voltage and stores data identifying a corresponding particular maximum value of the duty cycle of the phase-cut dimming signal.

11. The apparatus of claim 9, wherein the processor is configured to ascertain the peak voltage level of the AC line voltage by:

ascertaining a derivative of the phase-cut dimming signal;

ascertaining whether the derivative of the phase-cut dimming signal crosses zero; and when it is ascertained that the derivative of the phase-cut dimming signal crosses zero, finding the peak voltage level of the AC line voltage as a peak voltage level of the phase-cut dimming signal.

12. The apparatus of claim 11, wherein the processor is further configured such that when it ascertained that the derivative of the phase-cut dimming signal does not cross zero, the processor retrieves the peak voltage level of the AC line voltage from memory.

13. The apparatus of claim 9, wherein the processor is configured to ascertain the peak voltage level of the AC line voltage by:

ascertaining a derivative of the phase-cut dimming signal;

ascertaining whether the derivative of the phase-cut dimming signal crosses zero; and when it is ascertained that the derivative of the phase-cut dimming signal crosses zero, finding the peak voltage level of the AC line voltage as a voltage level of the phase-cut dimming signal at a time when the derivative of the phase-cut dimming signal crosses zero.

14. The apparatus of claim 9, wherein the processor controls the dimming of the LED-based lighting unit by ascertaining a ratio of an area under a voltage waveform of the phase-cut dimming signal to an area under a voltage waveform of the AC line voltage after rectification, and outputting an LED dimming signal dimming the LED-based lighting unit according to the ratio.

15. The apparatus of claim 9, wherein the processor controls the dimming of the LED-based lighting unit by looking up a dimming percentage for the LED-based lighting unit in a look-up table comprising a plurality of table entries each corresponding to a different value of the phase-cut angle and a corresponding value for the dimming percentage.

16. The apparatus of claim 9, further comprising a memory device having stored therein a look-up table comprising a plurality of data entries, and wherein the apparatus is configured, for each of a plurality of particular values for the peak voltage level of the AC line voltage, to:

measure a corresponding maximum value of the maximum duty cycle of the digital phase-cut dimming signal; and store each of the corresponding maximum values of the duty cycle of the digital phase-cut dimming signal in one of the table entries for the particular value of the peak voltage level of the AC line voltage.

* * * * *